US005100367A

United States Patent [19]

Abe

[11] Patent Number: 5,100,367

[45] Date of Patent: Mar. 31, 1992

[54] APPARATUS FOR CIRCULATING AND CLEANING COIN

[75] Inventor: Hiroshi Abe, Tokyo, Japan

[73] Assignee: Asahi Seiko Kabushiki Kaisha, Tokyo, Japan

[21] Appl. No.: 668,187

[22] Filed: Mar. 12, 1991

[30] Foreign Application Priority Data

Mar. 13, 1990 [JP] Japan ..... 2-59866

[51] Int. Cl.[5] ..... G07D 1/00

[52] U.S. Cl. ..... 453/49; 198/659; 453/57

[58] Field of Search ..... 453/49, 57; 211/203; 198/659, 676

[56] References Cited

U.S. PATENT DOCUMENTS

| | | | |
|---|---|---|---|
| 3,933,162 | 1/1976 | Smith | 453/57 |
| 4,148,331 | 4/1979 | Nicolaus | 453/57 X |
| 4,192,418 | 3/1980 | Montgomery | 198/659 |
| 4,496,086 | 1/1985 | Duchadeau | 198/659 X |
| 4,557,101 | 12/1985 | Hesterberg | 453/49 X |
| 4,589,433 | 5/1986 | Abe | 221/203 X |
| 4,615,350 | 10/1986 | Boudville | 453/57 |
| 4,742,852 | 5/1988 | White | 198/659 X |
| 4,753,625 | 6/1988 | Okada | 453/32 |
| 4,902,263 | 2/1990 | Ito et al. | 453/49 |
| 5,000,718 | 3/1991 | Abe | 453/57 |
| 5,016,397 | 5/1991 | Higginbotham | 453/63 X |

*Primary Examiner*—Robert J. Spar
*Assistant Examiner*—Scott L. Lowe
*Attorney, Agent, or Firm*—Nilles & Nilles

[57] ABSTRACT

An apparatus for circulating and cleaning coins in a game machine or the like comprises a coin feeder including a coin recovering hopper set in a game machine or any other machine; a coin recovering duct for recovering coins from the machine to the coin recovering hopper; a coin cleaning and transporting duct having an inlet connected to an outlet chute of the coin feeder; a coin supply hopper connected to an outlet of the coin cleaning and transporting duct for receiving coins from the coin cleaning and transporting duct and supplying coins to be used for the machine; and an overflow coin chute for passing coins from the coin supply hopper to the coin recovering hopper.

5 Claims, 3 Drawing Sheets

APPARATUS FOR CIRCULATING AND CLEANING COIN

BACKGROUND OF THE INVENTION

1. Field of the Invention

The present invention relates to an apparatus for circulating and cleaning coins such as medals used in game machines or the like.

2. Related Art Statement

Hitherto, in a game location wherein a plurality of game machines 1 such as a slot machine operated by coins or medals are set up in line as shown in FIG. 3, there is a coin circulating system comprising a coin supply conveyer 2 extended along and above the line of game machine for supplying coins to the individual game machines, a coin collecting conveyer 3 extended along and below the line of game machines for collecting coins from each game machine to a coin collecting vessel (not shown), and a vertical coin transporting duct or lifter operatively connected between the coin collecting vessel and the coin supply conveyer for returning coins from the coin collecting vessel to the coin supply conveyer.

Such a conventional coin circulating system requires high cost equipment and much maintenance in order to ensure a smooth supply of medals to each of the game machines without jamming of the medals in the coin supply and collecting conveyers.

Furthermore, the medals collected in the collecting vessel are usually cleaned by use of a separate cleaning device. Such a cleaning operation is generally performed after closing time of the game location, so that operators of the cleaning device are compelled to work for an extended hour after the closing time of the game location.

DISCLOSURE OF THE INVENTION

An object of the Invention is to solve the aforementioned problems and to provide a coin circulating and cleaning apparatus adapted to be incorporated in each game machines or the like.

According to the present invention, an apparatus for circulating and cleaning coins in a game machine or the like comprises a coin feeder including a coin recovering hopper set in a game machine or any other machine, a coin recovering duct for introducing coins recovered from the machine to the coin recovering hopper, a coin cleaning and transporting duct having an inlet connected to an outlet chute of the coin feeder, a coin supply hopper connected to an outlet of the coin cleaning and transporting duct for receiving coins from the coin cleaning ans transporting duct and supplying coins to be used for the machine, and an overflow coin chute for passing coins from the coin supply hopper to the coin recovering hopper.

According to a preferred embodiment of the present invention, a screen is interposed between the coin cleaning and transporting duct and the coin supply hopper for filtering coins from dust and foreign matter. The cleaning and transporting duct may be composed of a pipe, a rotating central shaft extended through the pipe, a brush screw formed by bristles of synthetic resin of the other non-metallic material helically secured around the rotating central shaft and means for driving the rotating central shaft. Preferably, the pipe of the cleaning and transporting duct may be partially filed with abradant balls.

Advantageously, the coin feeder comprises a coin recovering hopper for holding coins in bulk, a rotary disc rotatably disposed at an angle to the horizontal within the hopper and provided with a central circular stage with a brush having bristles of synthetic resin or the other-metallic material which are built in a plurality of radially extending bristle holding arms fixed on the surface of the central circular stage and further provided with a plurality of coin transporting pins which are protruded from a peripheral portion around the central circular stage and spaced apart in the peripheral direction of the rotary disc and outlet device for guiding coins pushed out of the hopper by means of the coin transporting pins.

DESCRIPTION OF THE PREFERRED EMBODIMENT

The invention will be described in more detail in the following with reference to the accompanying drawings.

Figure 1:
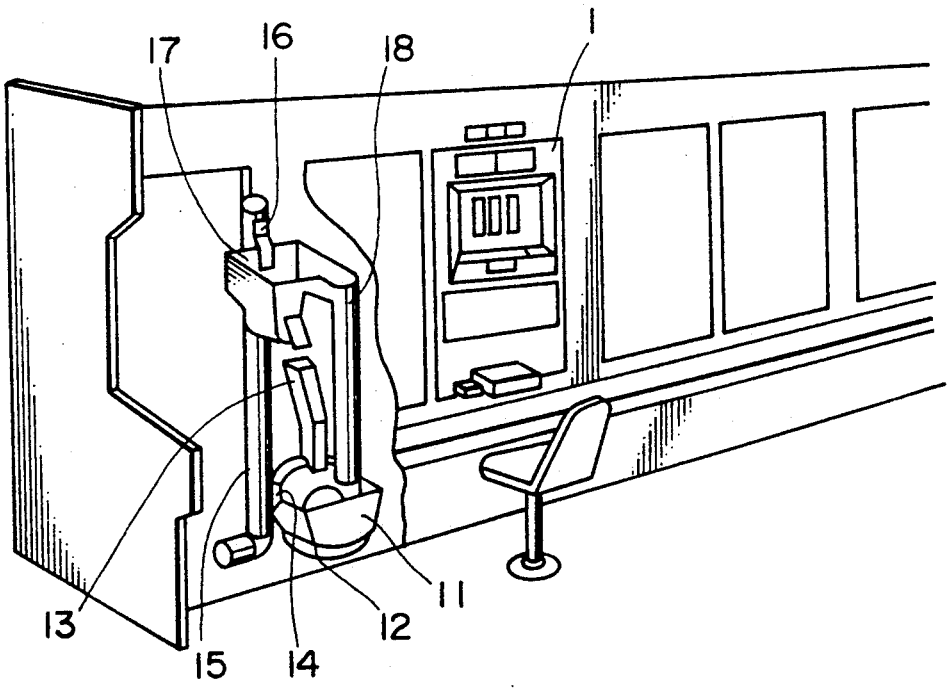
FIG. 1 is a schematic perspective view of an array of game machines showing a coin circulating and cleaning apparatus incorporated in a game machine with the array partially broken.
Figure 2:
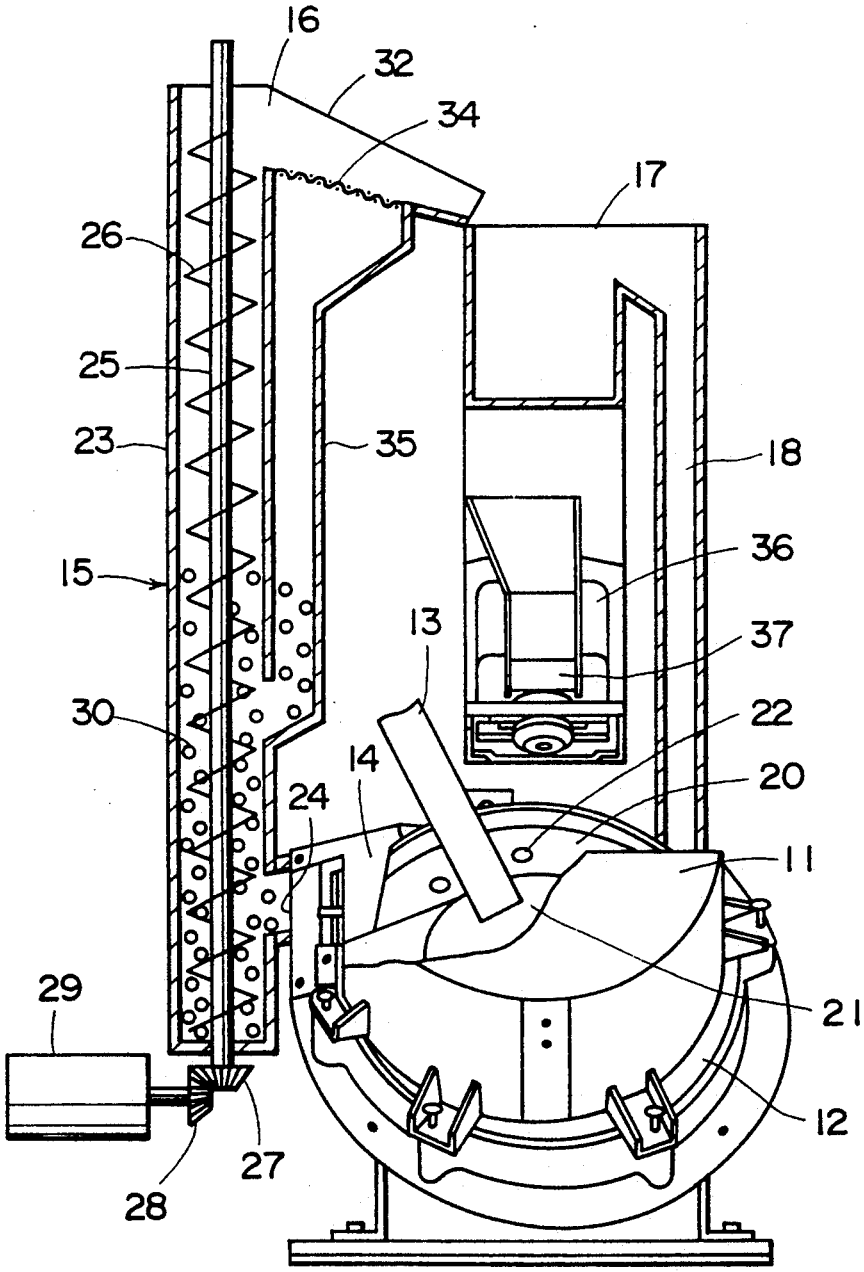
FIG. 2 is a schematic front view, partly in vertical section, of an embodiment of the coin circulating and cleaning apparatus.
Figure 3:
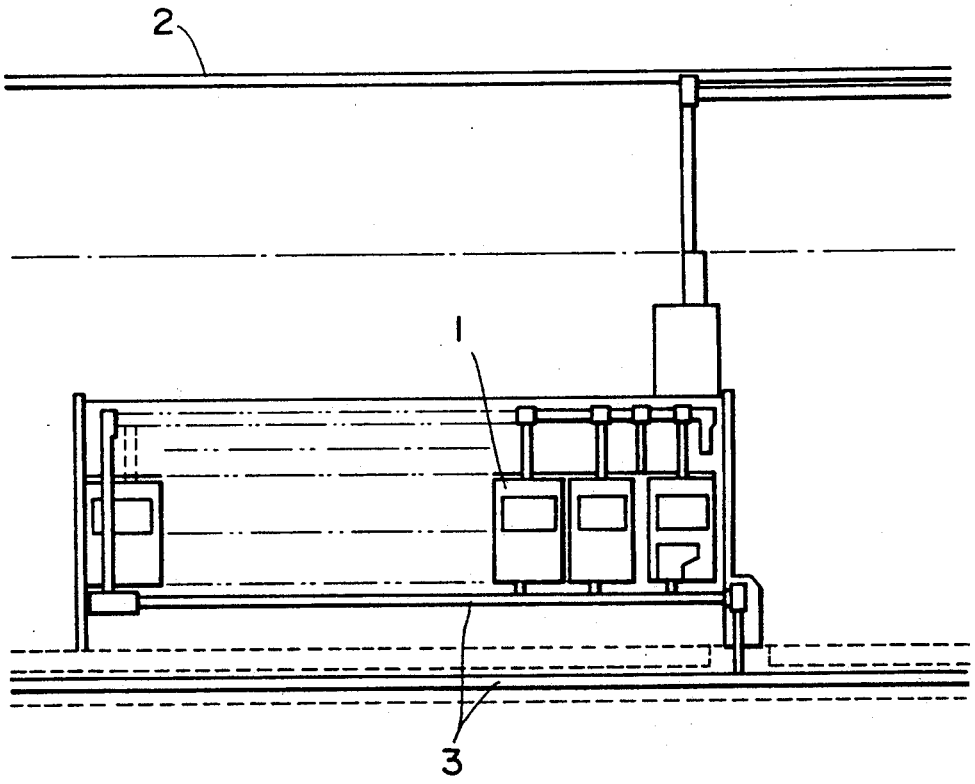
FIG. 3 PRIOR ART
FIG. 3 is a schematic elevational view of an array of game machines with a coin circulating system of prior art.

Referring to FIG. 2 illustrating one embodiment of the coin circulating and cleaning apparatus of the invention, a coins feeder 12 having a great capacity of a hopper type as disclosed in U.S. Pat. No. 4,589,433 is fixedly set in a lower portion of game machine. The coin feeder includes a coin recovering hopper 11 for holding a number of coins in bulk, a coin feeding rotary disc 20 which is rotatably disposed at an angle to the horizontal within the coin recovering hopper. The rotary disc 20 is provided with a central circular stage 21 and a plurality of coin transporting pins 22 which are protruded from a peripheral portion around the central circular stage 21 and spaced apart in the peripheral direction to define coin receiving spaces on the surface of the peripheral portion between sequential pins 22 such that when the rotary disc 20 is rotated, each coin transporting pin 22 picks up a coin into the individual coin receiving space from a gutter (not shown) formed between lower portions of the coin recovering hopper 11 and the rotary disc 20 and transports the coin into a outlet chute 14 through the upper delivery zone of the coin feeder and finally pushes the coin into a outlet chute 14.

A coin recovering duct 13 is located between the game machine and the coin recovering hopper 11 so as to introduce coin recovered from the game machine to the coin recovering hopper 11.

An up-standing coin cleaning and transporting duct 15 is disposed between the coin feeder 12 and the coin supply hopper 17. The coin cleaning and transporting duct 15 includes a guide pipe 23 having a lower side inlet opening 24 and an upper outlet opening 16 and a central rotating shaft 25 which extended through the guide pipe 23. The central rotating shaft 25 has a brush screw 26 formed by bristles of nylon helically secured around the rotating shaft 25 to provide a transporting screw. The rotating shaft 25 is extended through a bottom plate of the guide pipe 23 and is provided at the extended lower end with a bevel gear 27 which is engaged with a cooperating bevel gear 28 on an output shaft of an electric motor 29. The guide pipe 23 is partially filed with abradant balls 30 such as Polylon (trade name).

The guide pipe 23 is connected at the upper outlet opening 16 to a coin supply hopper 17 through a screen chute 32. The screen chute has an inclined bottom screen 34 which serves to separate dust and the abradant balls from the coins. A return pipe 35 has an open upper end positioned under the inclined bottom screen 24 and is communicated at the lower end to a lower portion of the guide pipe 23.

The coin supply hopper 17 may be of a coin payout hopper as disclosed in U.S. Pat. No. 4,752,274, which includes a coin payout mechanism 36 to dispense coins for operating the game machine from an outlet chute 37 which is connected to coin payout opening of the game machine in a conventional manner. The coin supply hopper 17 is connected to an overflow coin chute 18 to permit overflow coin passing to the coin recovering hopper 11.

With the arrangement mentioned above, during operation of the game machine, the coin feeder 12 is continuously operated to feed coins in the coin recovering hopper 11 to the guide pipe 23 of the coin cleaning and transporting duct 15 through the outlet chute 14 and the rotating shaft 25 is also continuously rotated in the guide pipe 23 to transport the coins from the inlet 24 to the outlet 16 by means of the brush screw 26. The coins are cleaned up by the brush on the central circular stage 21 in the coin recovering hopper 12 and/or the brush screw 26 in the guide pipe 23. The abradant balls 30 can additionally clean the surface of the coins. Thus cleaned coins pass from the upper outlet 16 of the guide pipe 23 to the coin supply hopper 17 through the screen chute 32. The coin supply hopper 17 including a coin dispensing mechanism can supply coins to the user of the game machine. Overflowed coins will return to the coin recovery hopper 11 through the overflow coin chute 18. Thus, the apparatus can circulate and clean coins in a game machine during its operation.

What is claimed is:

1. An apparatus for circulating and cleaning coins in a game machine comprising a coin feeder including a coin recovering hopper set in a game machine;

a coin recovering duct for introducing coins recovered from the machine to the coin recovering hopper;

a coin cleaning and transporting duct having an inlet connected to an outlet chute of the coin feeder;

a rotatable coin cleaning brush in said coin cleaning and transporting duct;

a coin supply hopper connected to an outlet of the coin cleaning and transporting duct for receiving coins from the coin cleaning and transporting duct and supplying coins to be used for the machine; and an overflow coin chute for passing coins from the coin supply hopper to the coin recovering hopper.

2. The apparatus claimed in claim 1, wherein a screen is interposed between the coin cleaning and transporting duct and the coin supply hopper for filtering coins from dust and foreign matter.

3. The apparatus claimed in claim 1, wherein the cleaning and transporting duct includes a guide pipe, a rotating central shaft extended through the guide pipe, said cleaning brush includes a brush screw formed by bristles of synthetic resin helically secured around the rotating central shaft and means for driving the rotating central shaft.

4. The apparatus claimed in claim 3, wherein the guide pipe of the cleaning and transporting duct may be partially filed with abradant balls.

5. The apparatus claimed in claim 1, wherein the coin feeder includes the coin recovering hopper for holding coins in bulk, a rotary disc rotatably disposed at an angle to the horizontal within the coin recovering hopper and provided with a central circular stage with a brush having bristles of synthetic resin which are built in a plurality of radially extending bristle holding arms fixed on the surface of the central circular stage and further provided with a plurality of coin transporting pins which are protruded from a peripheral portion around the central circular stage and spaced apart in the peripheral direction of the rotary disc and outlet device for guiding coins pushed out of the hopper by means of the coin transporting pins.

* * * * *